United States Patent [19]

Spain

[11] 3,952,466

[45] Apr. 27, 1976

[54] SPRING-LOADED WEAR PADS FOR CRANE BOOMS

[75] Inventor: Stanley R. Spain, Greencastle, Pa.

[73] Assignee: Walter Kidde & Company, Inc., Clifton, N.J.

[22] Filed: Aug. 8, 1974

[21] Appl. No.: 495,770

[52] U.S. Cl. ..... 52/118; 52/632; 308/3 C; 308/3.9

[51] Int. Cl.[2] ..... E04H 12/34

[58] Field of Search ..... 52/632, 118; 308/3 C, 308/3 R, 3 B, 3.9, 1 R; 212/55

[56] References Cited

UNITED STATES PATENTS 3,719.403 3/1973 Sung ..... 308/3

3,796,016 3/1974 Wu ..... 52/118

*Primary Examiner*—Frank L. Abbott
*Assistant Examiner*—Carl D. Friedman
*Attorney, Agent, or Firm*—Brady, O'Boyle & Gates

[57] ABSTRACT

A means to maintain the upper wear pads in a multi-section telescopic crane boom in contact with the side plates of the circumscribing boom section to reduce the transverse bending moment on the top plate of the boom section, thus reducing the stress thereon, and allowing the use of a thinner top plate so as to provide a lighter and less costly boom structure.

10 Claims, 6 Drawing Figures

FIG.2
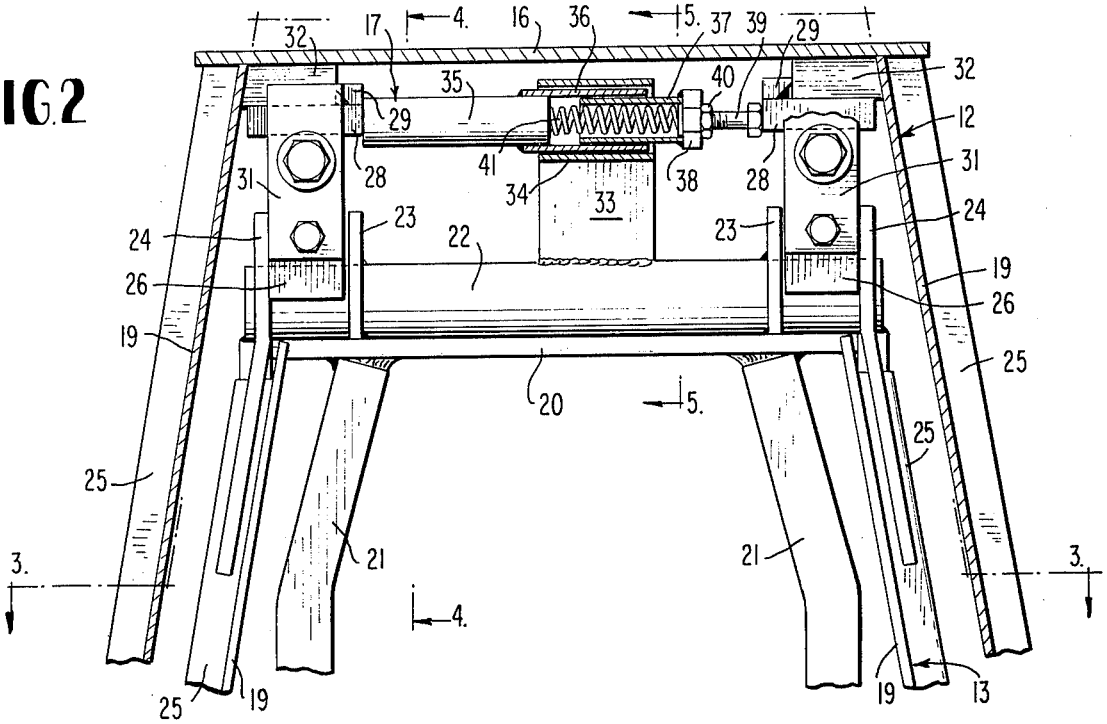
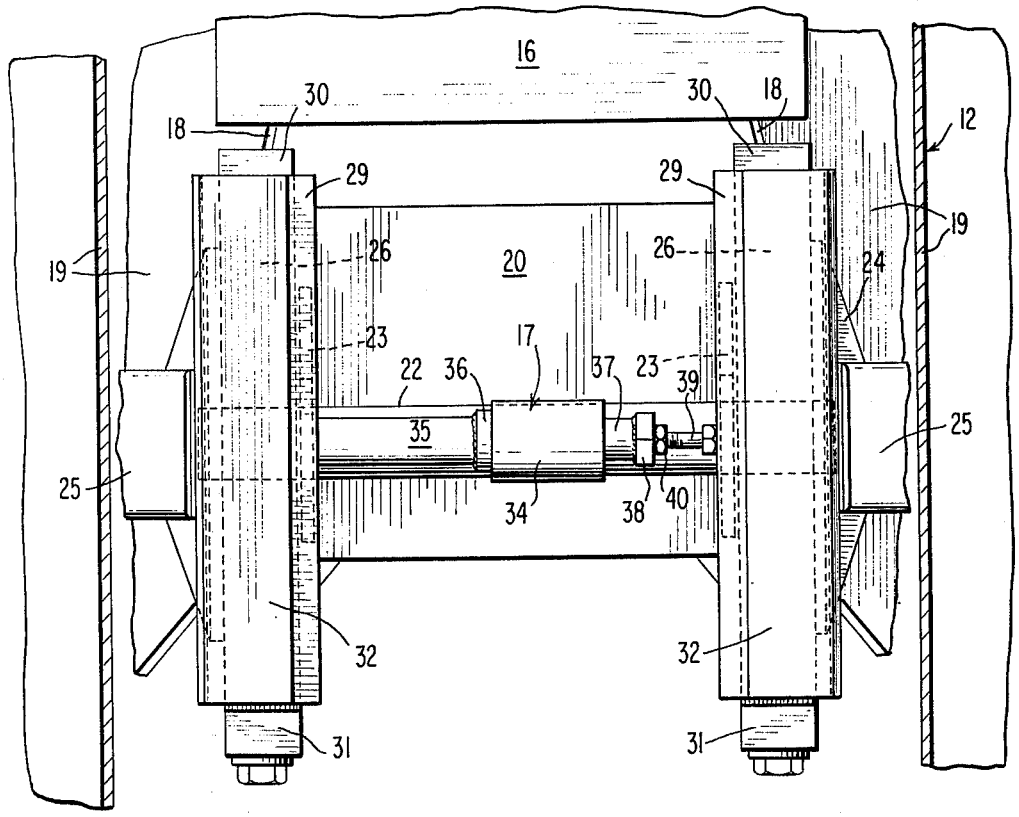
FIG.3

SPRING-LOADED WEAR PADS FOR CRANE BOOMS

BACKGROUND OF THE INVENTION

As the demand increases for construction cranes of the telescopic boom type having increased load lifting capacity, it becomes increasingly necessary to reduce the weight and cost of the boom structure itself without reduction in the strength thereof so as to produce a gain in the net load lifting capacity of the boom and crane.

In a plural section telescoping boom, one of the two reactions of each boom section, except the base section, is applied directly against the top plate of the next outermost or circumscribing boom section by two wear pads arranged near the two side plates of the circumscribing boom section.

The nearer these wear pads are to the side plates, the smaller will be the bending moment induced on the top plate of the circumscribing boom section. The smaller this bending moment, the less the top plate is stressed, thereby allowing the use of a thinner top plate with the desired advantages of lightness and reduction in cost.

By means of the present invention, the pairs of upper wear pads in a typical plural section telescopic boom are held constantly by an adjustable tension resilient means in sliding contact with the side plates of the adjacent circumscribing boom section, in constrast to prior practice where there was clearance between the wear pads and side plates. The upper wear pads utilized in the invention are also in sliding contact with the lower face of the top plate of the circumscribing boom section.

A feature of the invention is that the spring-loading mechanism for the two wear pads is free-floating axially in its support, and this free-floating action allows each inside boom section to move laterally within the circumscribing boom section without disturbing the spring-loading mechanism or interfering with the action of the springs in holding the upper wear pads in contact with the side plates.

Other important features and advantages of the invention will become apparent during the course of the following description.

BRIEF DESCRIPTION OF DRAWING FIGURES

FIG. 2 is an enlarged fragmentary vertical section illustrating a typical unit of the invention as viewed on lines 2—2, 2′—2′ or 2″—2″.

FIG. 3 is a fragmentary horizontal section taken on line 3—3 of FIG. 2.

DETAILED DESCRIPTION

Figure 1:
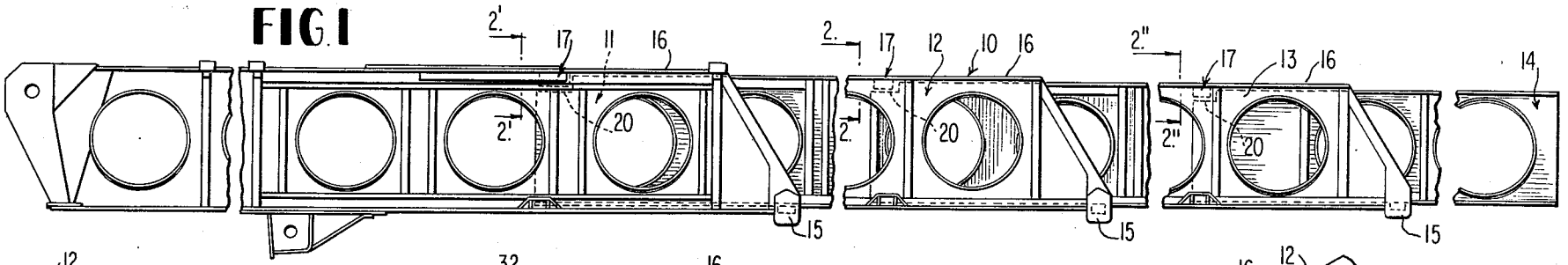
FIG. 1 is a fragmentary side elevation of a four section crane boom equipped with the invention.

Referring to the drawings in detail, wherein like numerals designate like parts, and referring initially to FIG. 1, a four section telescopic crane boom 10 is shown therein including base section 11, inner and outer mid-sections 12 and 13 and a fly section 14. In such a plural section boom, there are two reactions or pressure areas for each boom section except the base section 11. One such reaction for each boom section is applied against a lower wear pad assembly 15 of the adjacent circumscribing boom section, while the other reaction is applied against the top plate 16 of the next circumscribing boom section by the springloaded wear pad assemblies or units 17 which form the subject matter of the present invention. The construction of each springloaded wear pad assembly is substantially identical except for certain dimensional deviations caused by the difference in cross sectional size of the several boom sections, and therefore a detailed description of one unit of the invention should suffice to describe all of the units thereof in a plural section boom, such as indicated in FIG. 1.

Figure 6:
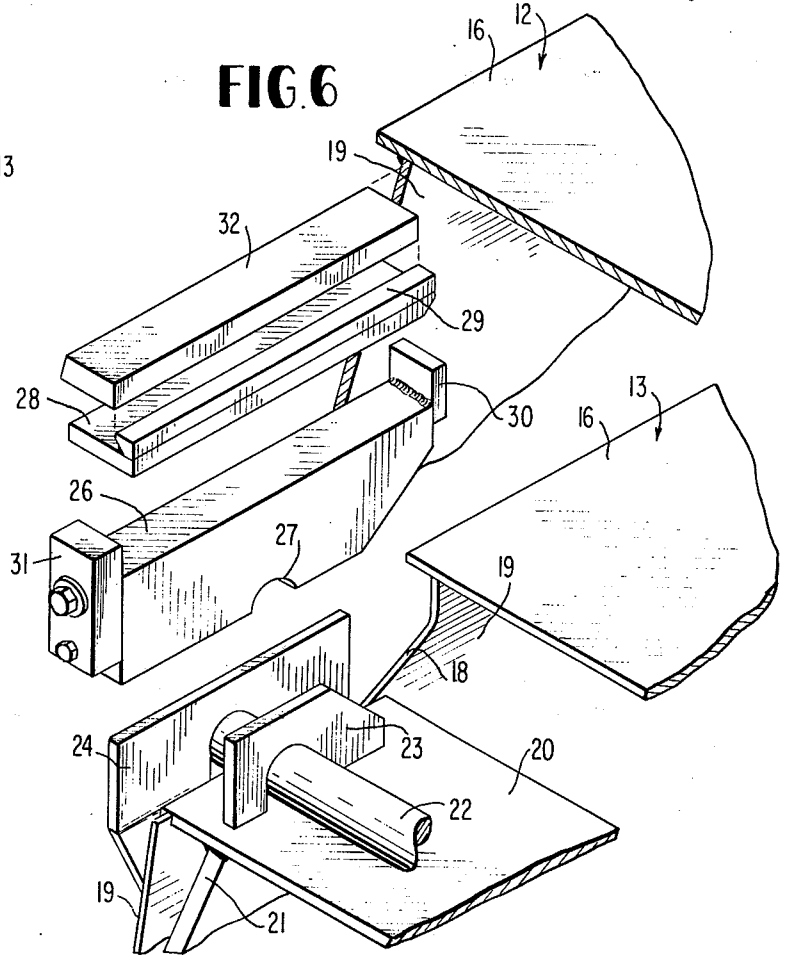
FIG. 6 is a fragmentary exploded perspective view of elements of the invention.
Figure 4:
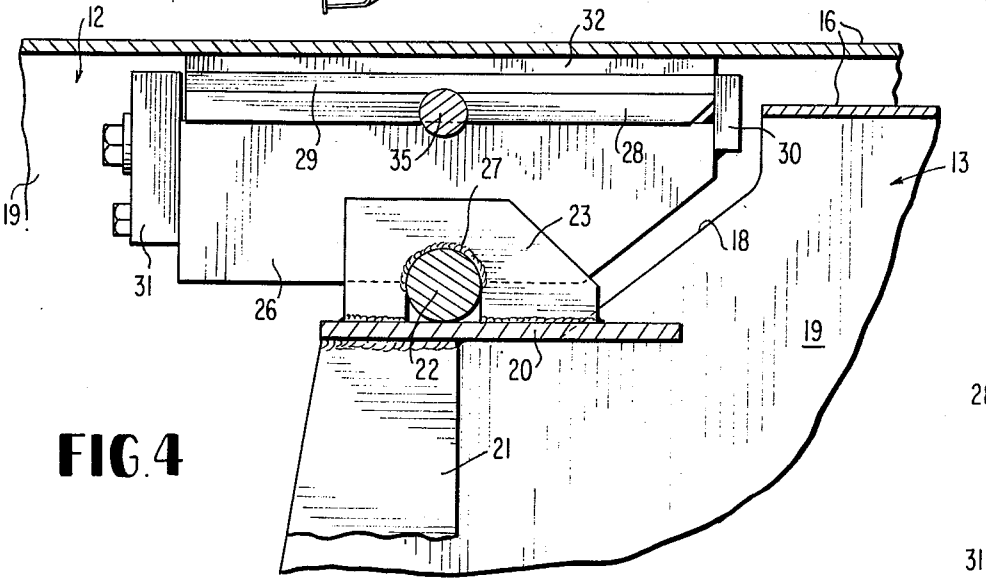
FIG. 4 is a fragmentary vertical section taken on line 4—4 of FIG. 2.
Figure 5:
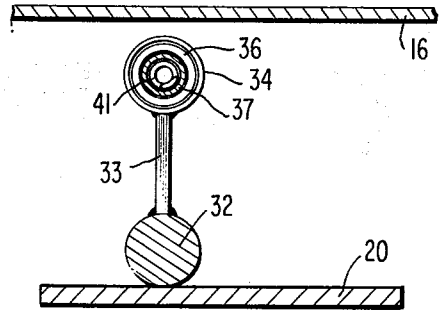
FIG. 5 is a similar section taken on line 5—5 of FIG. 2.

As shown clearly in FIGS. 4 and 6, the top rear end portion of each boom section 12, 13 and 14, for example, is cut away or notched as at 18 in the top plates 16 of the boom sections and in the corresponding side plates 19. A correspondingly depressed plate or platform section 20 is provided at the bottom of this notched area on each boom section, such plate section being firmly welded to members 21 forming a part of the support means for the hydraulic power cylinders of the boom, not shown. The plate sections 20 constitute the support elements or bases for the spring-loaded wear pad assemblies 17 of the invention.

Each such assembly 17 comprises a sturdy cylindrical bar 22 which spans the top of the adjacent plate section 20 transversely inside of the next circumscribing boom section, and is welded to the plate section. Pairs of spaced upstanding locator plates 23 and 24 are welded securely, respectively, to the bar 22 and plate section 20 and to reinforcing channel members 25 carried by the side plates 19.

Wear pad retainer support bars 26 of rectangular cross section are arranged above plate section 20 and each such bar has an arcuate seat 27 in its lower side near its longitudinal center receiving the upper portion of bar 22 rockably. The bars 26 thus extend both forwardly and rearwardly of the cylindrical bar 22 within the cut-away or recessed area 18 of the adjacent boom section.

Resting directly upon the top face of each support bar 26 is a wear pad retainer or seating means 28 having a longitudinal wear pad alignment element 29 welded thereto and extending along the interior edge thereof. The retainer 28 is restrained from longitudinal movement on the support bar 26 by a fixed abutment element 30 carried by one end thereof and a removable abutment element 31 secured to the other end thereof.

A wear pad 32 of suitable material rests directly on each retainer 28 with one longitudinal edge engaged with the element 29 and the opposite longitudinal edge contacting the adjacent boom section side plate 19. The cross sectional shape of the wear pads is determined by the shape of the boom, which in the present embodiment is shown to be trapezoidal. Should the boom be rectangular in cross section, the wear pads 32 will also be rectangular for proper face-to-face contact with the boom side plates. The two elements 30 and 31 project sufficiently far above the support bars 26 to overlap the ends of the wear pads 32 and restrain them against any appreciable endwise movement.

The assembly 17 further includes expander means to maintain the wear pads 32 in constant contact with side plates 19. This expander means comprises a support web 33 welded to the cylindrical bar 22 substantially centrally and projecting thereabove. A support sleeve 34 is welded to the top of the web 33 and has its axis parallel to the top plate 16 and transversely of the boom axis. A wear plate expander bar 35 having a fixed sleeve extension 36 on one end thereof has its opposite end directly abutting the interior side of one wear pad retainer 28. The sleeve extension 36 engages telescopically within the support sleeve 34. An adjusting sleeve 37 of the expander means is telescoped into the sleeve extension 36 movably and has a nut element 38 welded to its outer end receiving an adjusting screw 39 secured by a lock nut 40. The head of screw 39 directly engages the interior side of the other wear pad retainer 28, as best shown in FIG. 2. An expander coil spring 41 is arranged within the chamber formed by the interfitting sleeve components 36 and 37 and this spring may have its tension adjusted as required for best results by the adjusting screw 39. This same screw also serves to facilitate installing and removing the wear pads by relieving the spring force thereon at required times. During normal operation of the boom, the expander spring 41 exerts a constant force against the two pads 32 to maintain them in firm contact with the side plates 19 of the circumscribing boom section.

The spring 41 automatically adjusts to any increase or decrease in side plate spacing as one boom section is moved longitudinally relative to another boom section, and thus the proper wear pad contact is maintained.

As stated previously, the ultimate purpose of the invention is to minimize the transverse bending moment on the top plate 16 and thus reduce the stress therein so that a thinner plate may be employed. By having the wear pads 32 constantly expanded into the far corners of the circumscribing boom section, this objective is achieved and the reaction forces at the two upper wear pads are essentially through the lateral centers of the support bars 26 as viewed in FIG. 2.

Another important feature of the structure is the arrangement whereby the spring-loaded expander means including elements 35, 36, 37 and 39 is free-floating axially in the support tube 34. This floating action allows the interior boom section 13, FIG. 2, to move laterally or sidewise within the circumscribing boom section 12 without disturbing the action of the spring in maintaining the wear pads 32 in contact with side plates 19. During such lateral movement of the boom sections, the wear pad retainers 28 are also free to slide laterally on the upper faces of the retainer support bars 26. Therefore, it may be seen that the entire mechanism is essentially self-adjusting or self-compensating in response to the relative movements of the boom sections which inevitably occur during normal operations.

It is believed that the advantages of the invention over the prior art should now be clear to anyone skilled in the art without further detailed description herein.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. In a crane boom having relatively movable telescopic sections including at least one circumscribing boom section having a top plate which is subject to transverse bending moments and stresses during normal operations and a pair of side plates connected therewith, the improvement comprising a pair of upper wear pads arranged between said telescopically interfitting boom sections, means connected to the interior boom section of said interfitting pair of boom sections and supporting such wear pads on the interior boom section in sliding contact with said top plate of said circumscribing boom section, said wear pads slidably connected on said supporting means for lateral sliding movement relative thereto and to said boom sections, and wear pad expander means connected between and in contact with said wear pads and constantly expanding the wear pads laterally relative to the interior boom section and urging the outer sides of the wear pads into sliding contact with the side plates of said circumscribing boom section at the connection of the side plates with the top plate thereof.

2. The structure defined by claim 1, wherein said wear pad expander means comprises a device carried by the means supporting such wear pads and directly engaging the interior sides of said upper wear pads to expand them laterally into contact with said side plates.

3. The structure defined by claim 2, and said means supporting said wear pads comprising a pair of retainer support bars connected in spaced relation on the interior boom section of an interfitting pair of boom sections, a pair of wear pad retainers seated on said support bars and being free to slide laterally thereon and restrained against longitudinal movements, said pair of upper wear pads resting on said retainers.

4. The structure defined by claim 3, and an interior side wear pad alignment and abutment element on each wear pad retainer engaging the interior side of the wear pad resting thereon and operative to move the wear pad laterally with the wear pad retainer, and said wear pad expander device engaging the interior sides of said pair of wear pad retainers and slidably urging them laterally on said support bars.

5. The structure defined by claim 2, and an element forming a part of said means supporting such wear pads and engaging and suppprting said expander device in such a manner that the expander device is free-floating in said element laterally of the boom and in the direction between the pair of upper wear pads.

6. The structure defined by claim 5, and said element comprising an open-ended sleeve surrounding the expander device.

7. In a crane boom having relatively movable telescopic sections including boom section top plates which are subject to transverse bending moments and stresses during normal operations, the improvement comprising a pair of upper wear pads arranged between telescopically interfitting boom sections, a firm wear pad support on the interior boom section of an interfitting pair of boom sections supporting such wear pads in sliding contact with a top plate of a circumscribing boom section, an adjustable tension spring-loaded wear pad expander device carried by said support and directly engaging the interior sides of said upper wear pads to constantly expand the wear pads laterally into sliding contact with side plates of the circumscribing boom section, and said spring-loaded device being laterally free-floating relative to said support.

8. The structure defined by claim 7, and said expander device comprises a pair of interfitting relatively movable components, and an expander spring engaged with said components and urging them to separate.

9. The structure defined by claim 8, wherein one component comprises an expander bar engaging the interior side of one wear plate retainer, and the other component comprises a lockable theaded adjustment element engaging the interior side of a second wear plate retainer.

10. In a crane boom having relatively movable telescopic sections including boom section top plates which are subject to transverse bending moments and stresses during normal operations, the improvement comprising a pair of upper wear pads arranged between telescopically interfitting boom sections, means supporting said wear pads in sliding contact with a top plate of a circumscribing boom section including a transverse support bar carried by said interior boom section beneath said pair of upper wear pads, a pair of retainer support bars in spaced relation on the interior boom sections of an interfitting pair of boom sections, said retainer support bars recessed in their bottoms with said recesses receiving said transverse support bar rockably, a pair of wear pads retainers seated on said support bars and being free to slide laterally thereon and restrained against longitudinal movements, said pair of upper wear pads resting on said retainers, an interior side wear pad alignment and abutment element on each wear pad retainer engaging the interior side of the wear pad resting thereon, and a wear pad expander device carried by the means supporting said wear pads and engaging the interior sides of said wear pad retainers and constantly expanding said wear pads resting thereon laterally into sliding contact with side plates of the circumscribing boom section.

* * * * *